US012674307B2

(12) United States Patent
Sale et al.

(10) Patent No.: US 12,674,307 B2
(45) Date of Patent: Jul. 7, 2026

(54) FLUID DELIVERY DEVICE WITH DIAGNOSTICS READ THROUGH SMART DEVICE

(71) Applicant: Delta Faucet Company, Indianapolis, IN (US)

(72) Inventors: Michael Sale, Kirkwood, MO (US); Joshua Wales, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 23 days.

(21) Appl. No.: 18/517,779

(22) Filed: Nov. 22, 2023

(65) Prior Publication Data

US 2024/0218644 A1 Jul. 4, 2024

Related U.S. Application Data

(60) Provisional application No. 63/436,229, filed on Dec. 30, 2022.

(51) Int. Cl.
*E03C 1/05* (2006.01)
*E03C 1/04* (2006.01)

(52) U.S. Cl.
CPC ..... *E03C 1/057* (2013.01); *E03C 1/0404* (2013.01); *Y10T 137/9464* (2015.04)

(58) Field of Classification Search
CPC ..... E03C 1/055; E03C 1/057; E03C 1/0404; E03C 1/05; E03C 2001/0418; Y10T 137/9464; F16K 37/0058
USPC ..... 137/801
See application file for complete search history.

(56) References Cited

U.S. PATENT DOCUMENTS

| | | | | |
|---|---|---|---|---|
| 7,188,002 | B2 | 3/2007 | Chapman, Jr. et al. | |
| 7,753,074 | B2 | 7/2010 | Rosko et al. | |
| 8,922,369 | B2 | 12/2014 | Sawaski | |
| 9,128,931 | B2 | 9/2015 | DeVos | |
| 9,197,437 | B2 | 11/2015 | Kim et al. | |
| 9,495,859 | B2 | 11/2016 | Ha et al. | |
| 9,979,560 | B2 | 5/2018 | Kim et al. | |
| 10,015,021 | B2 | 7/2018 | Shin et al. | |
| 10,227,760 | B2 | 3/2019 | Horwitz et al. | |
| 10,323,393 | B2 | 6/2019 | Thompson et al. | |
| 10,633,842 | B2 | 4/2020 | Tayenaka et al. | |
| 10,751,892 | B2 | 8/2020 | Godlieb et al. | |
| 10,920,404 | B2 | 2/2021 | Hirsch | |
| 11,001,509 | B2 | 5/2021 | Schuster | |
| 11,255,076 | B2 | 2/2022 | Floyd et al. | |
| 2016/0129464 | A1* | 5/2016 | Frommer | B05B 12/008 700/282 |
| 2022/0121228 | A1 | 4/2022 | Hobbs et al. | |

(Continued)

FOREIGN PATENT DOCUMENTS

| | | | | |
|---|---|---|---|---|
| CN | 113688964 A | * | 11/2021 | G06F 18/214 |
| EP | 2555474 B1 | | 8/2020 | |
| WO | WO-2019216771 A1 | * | 11/2019 | |

OTHER PUBLICATIONS

CN113688964A—Machine Translation (Year: 2021).*

(Continued)

*Primary Examiner* — Daphne M Barry
(74) *Attorney, Agent, or Firm* — Bose McKinney & Evans LLP

(57) ABSTRACT

A fluid delivery device including an indicator configured to provide diagnostics read through a smart device.

18 Claims, 5 Drawing Sheets

(56) References Cited

U.S. PATENT DOCUMENTS

| | | | | |
|---|---|---|---|---|
| 2022/0162838 | A1 | 5/2022 | Alteon | |
| 2023/0366182 | A1* | 11/2023 | Scheffer | E03C 1/057 |

OTHER PUBLICATIONS

Sloan; Optima Faucets Smart water management made simple; Nov. 1, 2020; retrieved from https://www.sloan.com/sites/default/files/2018-07/20180725-underdeck-trifold-brochure-digital.pdf; 6 pages.

Zurn; Connected Camaya Series Sensor Faucet; retrieved on Sep. 20, 2022 from https://www.zurn.com/products/smart-connected-products/sensor-faucets/z6953-xl-w2; 3 pages.

* cited by examiner

FLUID DELIVERY DEVICE WITH DIAGNOSTICS READ THROUGH SMART DEVICE

CROSS-REFERENCE TO RELATED APPLICATION

The present application claims priority to U.S. Provisional Patent Application Ser. No. 63/436,229, filed Dec. 30, 2022, the disclosure of which is expressly incorporated herein by reference.

BACKGROUND AND SUMMARY OF THE DISCLOSURE

The present invention relates generally to a fluid delivery device and, more particularly, to an electronic fluid delivery device (e.g., a faucet, a valve or a filtration device) including diagnostics read through a smart device.

Electronic product diagnostics are often limited to specific cues that are easily understood by the user (for example, a red blinking light for low battery). This limits the complexity of the message that can be communicated and understood by the user so that action can be taken. As electronic products are connected via known communication protocols (for example, Wi-Fi and Bluetooth) this information can be more easily conveyed directly to the user.

The present invention aims to bridge the gap to add value to non-connected electronic products for deeper and more effective communication to a user. More particularly, the electronic non-connected product (e.g. electronic faucet, digital shower, filtration device, etc.) includes a series of diagnostic communications which are signaled to the user. These signals could be via lights (e.g., color, pulse and/or intensity), display screens (e.g., text, number codes, etc.) or even water delivery (pulses of water from the outlet). The user may use a smart phone that is configured to capture the communication (e.g. via an application) and translate it to a message that could lead to some type of action. These messages could confirm, for example, a successful installation, alert of product issues (e.g., problematic install, clogged filter, capacitance readings are too high, batteries are running low more quickly than expected, etc.), and/or provide information (e.g., communicate exact percentage of remaining filter life, etc.).

According to an illustrative embodiment of the present disclosure, a fluid delivery device is configured to deliver diagnostics read through a smart device. The fluid delivery device includes a faucet body having a spout, a fluid passageway supported by the spout, the spout having an outlet configured for dispensing fluid, a faucet visual indicator, and a controller operably coupled to the faucet visual indicator. A smart device having a camera is configured to receive output from the faucet visual indicator. The output from the faucet visual indicator is captured by the camera and communicated to the smart device. The smart device includes a processor configured to translate the output to a message for a user.

According to another illustrative embodiment of the present disclosure, a fluid delivery device is configured to deliver diagnostics read through a smart device. The fluid delivery device includes a fluid passageway and a visual indicator operably coupled to the fluid passageway. A controller is operably coupled to the visual indicator. A smart device includes a processor and a camera operably coupled to the processor, the camera being configured to receive output from the visual indicator. The output from the visual indicator is captured by the camera and communicated to the processor. The processor of the smart device is configured to translate the output to a message for a user.

According to a further illustrative embodiment of the present disclosure, a fluid delivery device is configured to deliver diagnostics read through a smart device. The fluid delivery device includes a faucet body having a spout, and a fluid passageway supported by the spout, the spout having an outlet configured for dispensing fluid. A controller is operably to a faucet indicator. The output from the faucet indicator is captured by an input device of a smart device. A processor of the smart device is configured to translate the output to a message for a user.

According to another illustrative embodiment of the present disclosure, a fluid delivery device is configured to deliver diagnostics read through a smart device. The fluid delivery device includes a fluid passageway, a visual indicator operably coupled to the fluid passageway, and a controller operably coupled to the visual indicator. Output from the visual indicator is configured to be captured by a camera of a smart device. The smart device is configured to translate the output to a visual message for a user. The illustrative fluid delivery device may include a faucet or a fluid treatment device, such as a reverse osmosis device.

Additional features and advantages of the present invention will become apparent of those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
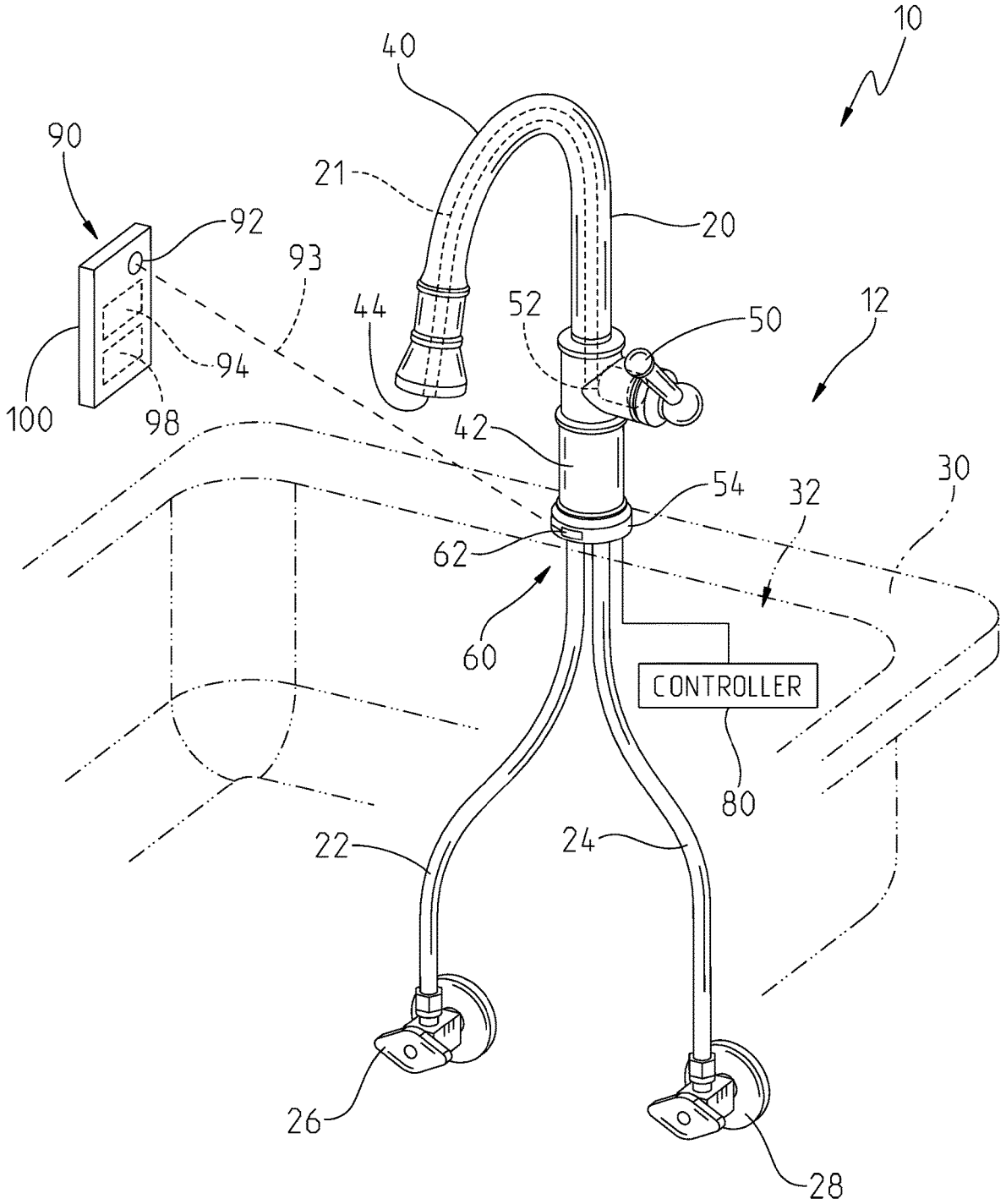
FIG. 1 is a perspective view of an illustrative fluid delivery device of the present disclosure.

For the purposes of promoting and understanding the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

Figure 4:
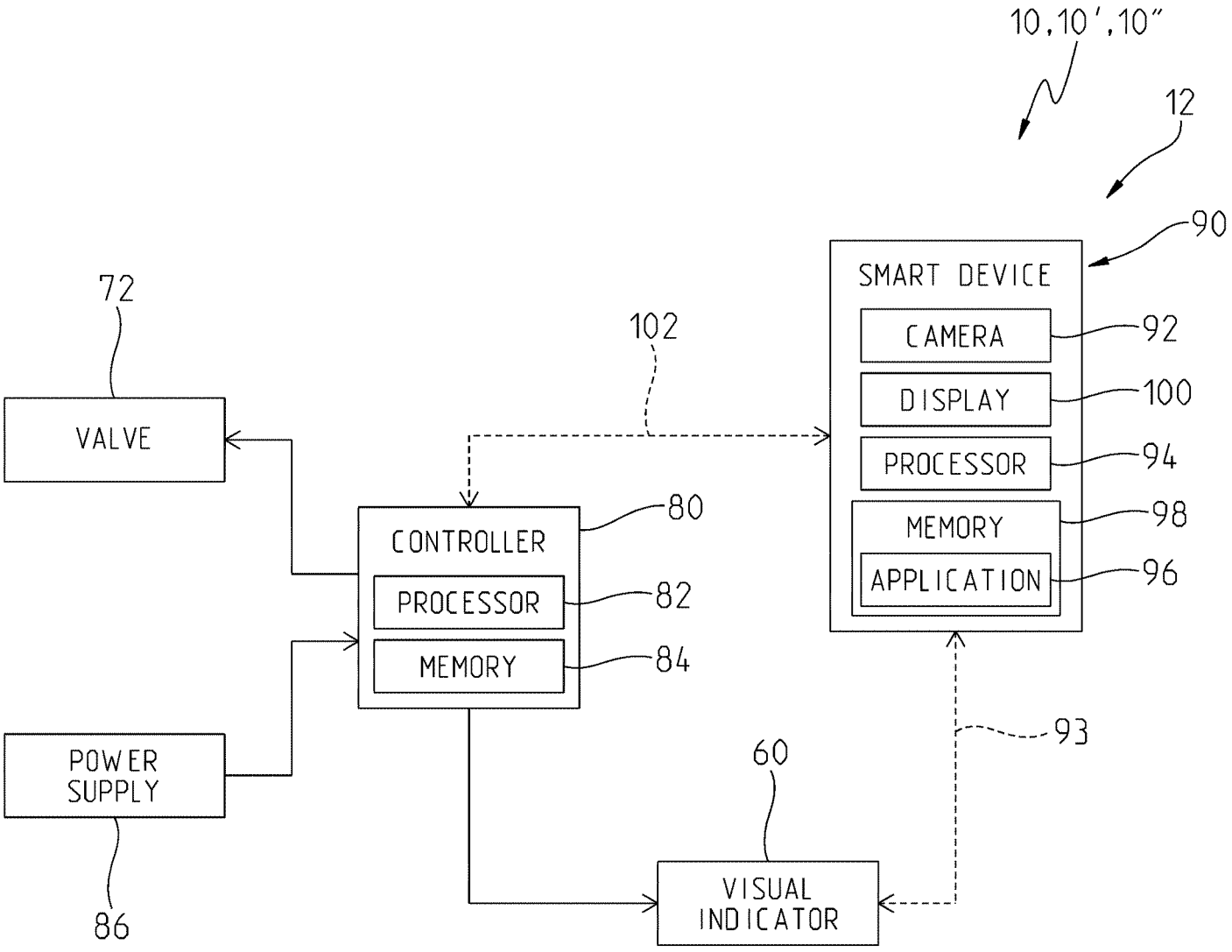
FIG. 4 is a block diagram of the illustrative fluid delivery device of FIG. 1.

Referring initially to FIGS. 1 and 4, an illustrative fluid delivery device 10 is shown for use with a diagnostics system 12 of the present disclosure. Fluid delivery device 10 is illustratively shown as an electronic faucet assembly. As further detailed herein, other illustrative fluid delivery devices 10 may include electrically operable valves (e.g., electronic shower valves) and water treatment devices (e.g., water filters and reverse osmosis (RO) systems).

Illustrative faucet assembly 10 includes a faucet body 20 which supports an outlet fluid passageway 21 for delivering fluids, for example, water. In the illustrative embodiment, faucet assembly 10 includes a fluid conduit 22 for supplying hot water and a fluid conduit 24 for supplying cold water. Hot water conduit 22 connects to a hot water source 26 (illustratively, a conventional hot water stop) and cold water conduit 24 connects to a cold water source 28 (illustratively, a conventional cold water stop).

Faucet assembly 10 is shown supported by a conventional support structure 30, such as a countertop or sink deck above a basin or sink 32. The illustrative faucet body 20 includes an upper faucet body having a spout 40 supported by a hub 42 which is mounted on the sink deck 30. The spout 40 supports a water outlet 44 defined by the fluid passageway 21 for dispensing water into the sink basin 32. Spout 40 is illustratively rotatable relative to hub 42 about a vertical axis whereby the position of water outlet 44 above sink basin 32 can be adjusted.

Illustratively, a handle 50 is operably coupled to a mixing valve 52 supported by the faucet body 20 and allows a user to manually adjust the temperature and flow rate of water being discharged from spout 40. More particularly, the mixing valve 52 includes inlets fluidly coupled to the hot water fluid conduit 22 and the cold water fluid conduit 24, and an outlet fluidly coupled to the outlet fluid passageway 21. An illustrative mixing valve 52 is shown in U.S. Pat. No. 7,753,074 to Rosko et al., the disclosure of which is expressly incorporated herein by reference.

The faucet assembly 10 also illustratively includes an output device or indicator 60, such as a faucet visual indicator. In other illustrative embodiments, the output device or indicator 60 could be an audible device (e.g., a speaker) to provide an auditory indication (e.g., beep, chirp, etc.). Illustrative faucet visual indicator 60 provides a visual indication of operation, mode, or status to a user of the faucet assembly 10. In one illustrative embodiment, the faucet visual indicator 60 is a light indicator 62 (FIG. 1). For example, one or more light emitting diodes (LEDs) may provide illumination during different operating conditions of the faucet assembly 10. Flashing patterns or different colors of the light indicator 62 may correlate to different indications to the user. Illustratively, the light indicator is positioned on a base 54 supporting the hub 42.

Figure 2:
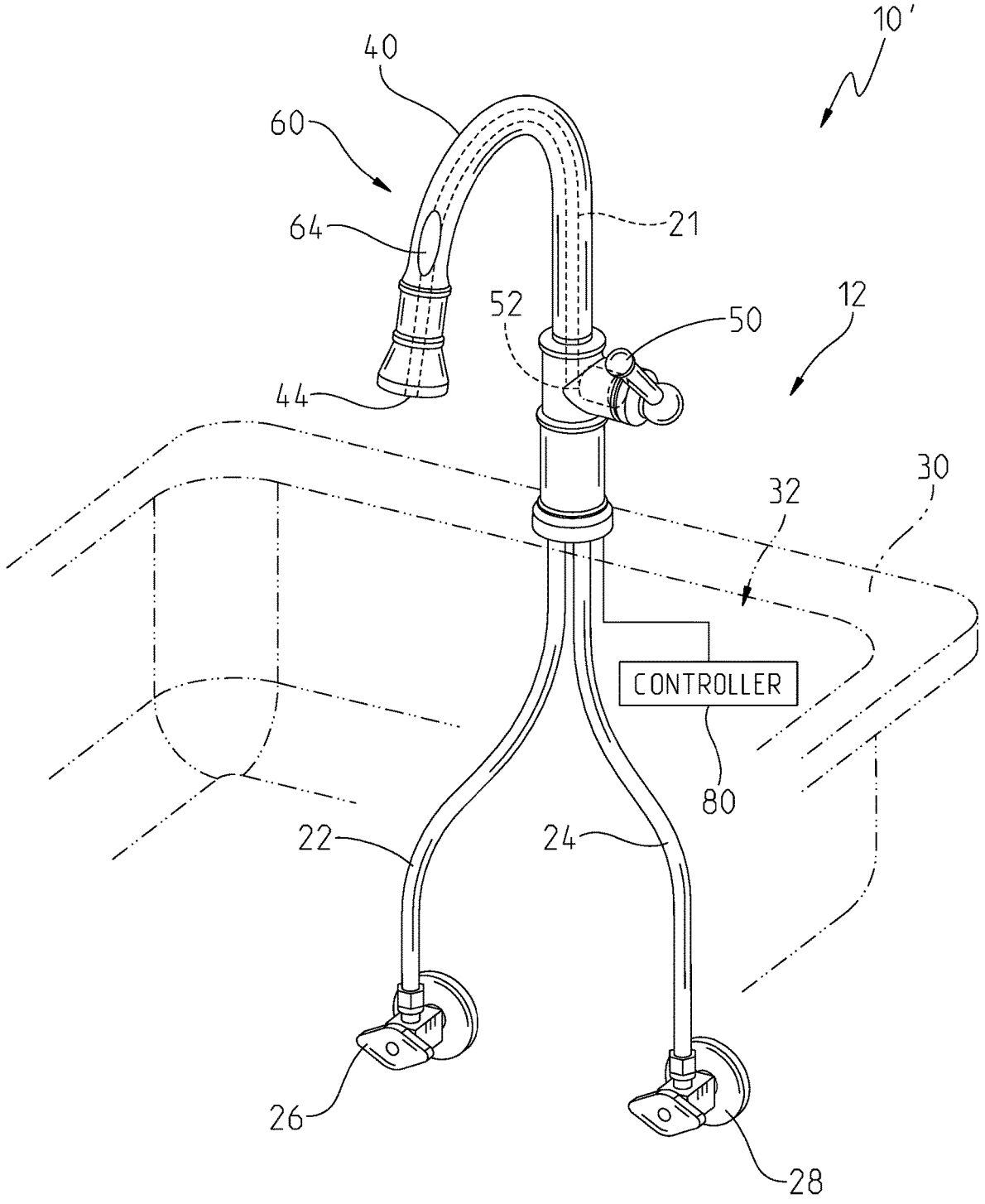
FIG. 2 is a perspective view another illustrative fluid delivery device of the present disclosure.

With reference to FIG. 2, another illustrative embodiment faucet 10' is shown where the indicator 60 can be a visual display 64. Illustratively, the display 64 is a screen (e.g., a liquid crystal display (LCD)) positioned on the spout 40 of the faucet assembly 10. Display 64 may provide various outputs, such as visible indicia (e.g., barcodes, texts, QR codes, or the like) to provide various indications to the user of the faucet assembly 10'.

Figure 3:
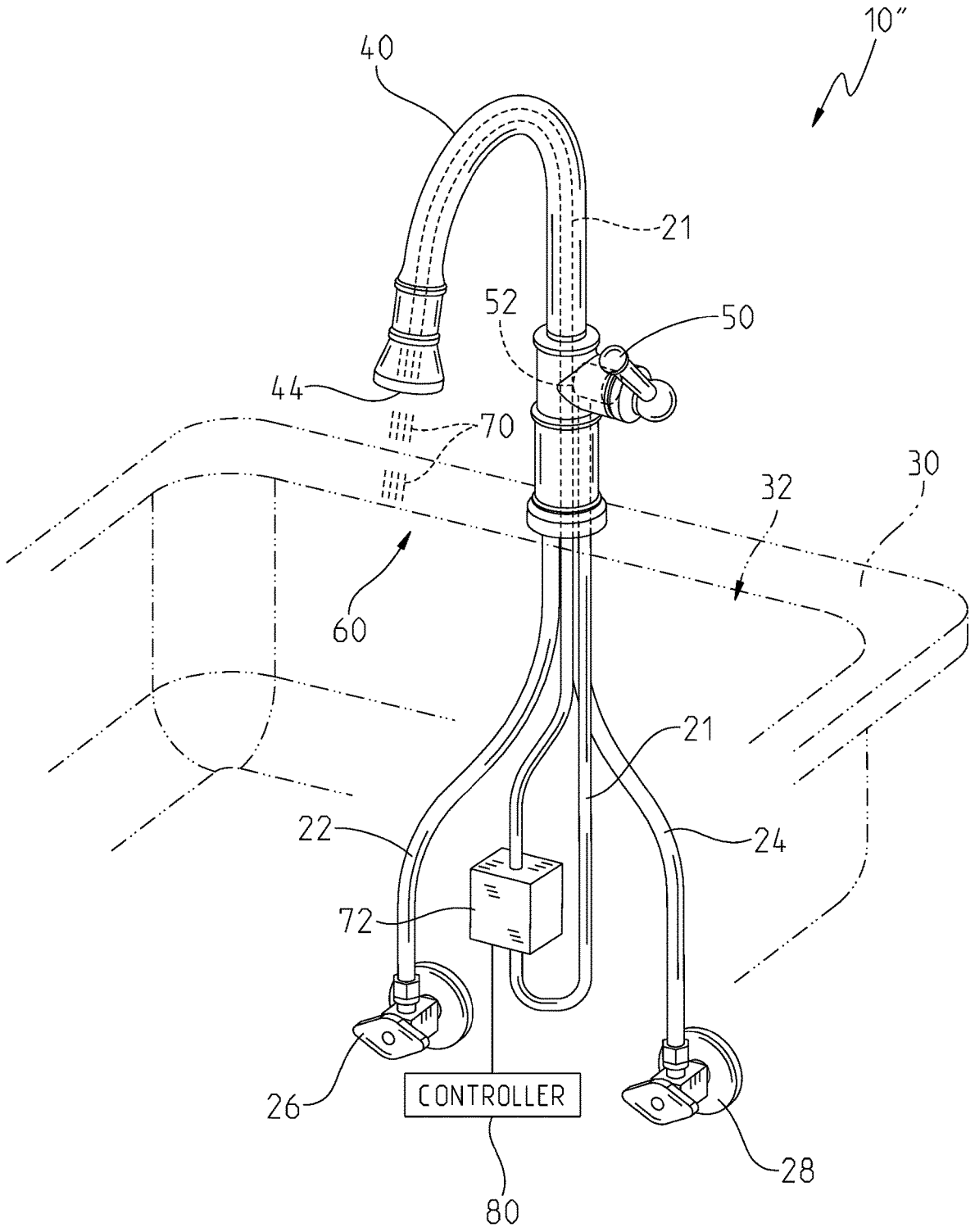
FIG. 3 is a perspective view another illustrative fluid delivery device of the present disclosure.

With reference to FIG. 3, another illustrative embodiment faucet 10" is shown where the indicator 60 is a pattern of fluid pulses 70 at the water outlet 44 to provide indications of different status, maintenance, or servicing conditions of the faucet assembly 10. The pulses may be provided by an electrically operable valve 72 fluidly coupled to the outlet fluid passageway 21.

With reference to FIG. 4, the diagnostics system 12 of the faucet assembly 10,10',10" illustratively includes a controller 80 having a processor 82 in electrical communication with a memory 84. Illustratively, control logic in the form of software is stored in the memory 84 for execution by the processor 82. Illustratively, the controller 80 is electronically coupled to the indicator 60 (e.g., light indicator 62, display 64 and/or electrically operable valve 72).

With respect to the illustrative faucet assembly 10 (FIG. 1), the controller 80 illuminates light indicator 62 during conditions that are preset in the control logic. With respect to the illustrative faucet assembly 10' (FIG. 2), the controller 80 displays various outputs on the display 64 during conditions that are preset in the control logic. With respect to the illustrative faucet assembly 10" (FIG. 3), the controller 80 also electronically controls the electrically operable valve 72 to control water output at the water outlet 44 and provide a pattern of fluid pulses 70. Additional details of an illustrative valve 72 to provide a pattern of fluid pulses 70 are disclosed in U.S. Pat. No. 8,922,369 to Sawaski, the disclosure of which is expressly incorporated herein by reference.

The light from the light indicator 62, the indicia on the display 64, and/or the series of pulses 70 may provide the user with diagnostic information, such as fault codes, error codes, system status or other indication of which components of the electronic faucet 10, 10', 10", respectively, are malfunctioning or that need to be serviced or replaced. The light from the light indicator 62, the indicia on the display 64, and/or the series of pulses 70 may provide the user with environmental factors (e.g. ambient environment or water conditions, or water quality issues). The particular output corresponding to particular maintenance or servicing conditions may be stored in a database or table in memory 84 accessible by controller 80. The controller 80 is provided electrical power by a conventional power supply 86.

A smart device 90 illustratively includes an input device 92, such as a reader (e.g., a camera) and is configured to receive the output from the faucet visual indicator 60 via a communication line 93. In other illustrative embodiments, the input device 92 could be a microphone to receive input from an audible device defining the indicator 60. For example, a series of auditory beeps or tones may convey information to the input device 92.

Illustratively, the camera 92 is operably coupled to a processor 94 configured to execute software 96 (e.g., an application) stored in a memory 98. The smart device 90 further illustratively includes an output device 100, such as a display screen, in electrical communication with the processor 94 for displaying a visual output therefrom to the user.

In certain illustrative embodiments, the smart device 90 can be connected to the controller 80 and the indicator 60 through any type of wireless communication technology along communication line 102, including but not limited to Wi-Fi, Bluetooth, ZigBee, and Z-wave. In certain illustrative embodiments, the wireless communication technology may be near-field communication (NFC). For example, a user could tap the smart device 90 on a portion of the faucet assembly 10 (e.g., the faucet visual indicator 60) to wirelessly share information. In other illustrative embodiments, the wireless communication technology may be radio frequency identification (RFID). In certain illustrative embodiments, a user could be alerted by the indicator 60, for example, the pattern of fluid pulses 70, to wirelessly connect the smart device 90 to the controller 80.

Outputs of the controller 80 can be tracked and monitored via a mobile application 96 on the smart device 90. Similarly, in an illustrative embodiment, the user can control inputs to the controller 80 via a mobile application on the smart device 90. As such, the smart device 90 or other wireless communication interface can be used to control the faucet assembly 10. This could be through a direct link, or through a hub or network. The ability to control the faucet assembly 10 with the smart device 90 is particularly useful for initial setup or modification of device settings.

In one illustrative embodiment, the user utilizes the camera 92 on the smart device 90 to read outputs of the indicator 60 (e.g., the light indicator 62, the display 64, and/or the fluid pulses 70) via communication line 93. The mobile application 96 on the smart device 90 captures the communication and translates it to a message for the user. The message could be provided to the user on the display screen 100 of the smart device 90. Alternatively, the message could be provided to the user via an audible device, such as a speaker.

Illustratively, these messages could confirm a successful installation, alert of product issues such as problematic installation, clogged filter, capacitance readings that are too high, batteries are running low more quickly than they should, and/or provide information such as communicating the exact percentage of remaining filter life. The messages could also provide other identifying information such as the device age, serial number, model, or other information that could be used to direct a user to correct trouble shooting information, parts to be replaced, etc. The outputs of the light indicator 62, the display 64, and/or the fluid pulses 70 could detail a variety of product diagnostics, maintenance, and repairs as needed. For example, is an issue occurred over time, a blinking LED or a specific pattern of pulsing water could communicate to the user (via the camera 92 and mobile application on the smart device 90) specific action that needed to be taken to remedy the issue.

In one illustrative embodiment, the camera 92 could read the pattern of fluid pulses 70 or a code on the display 64, doing away with the need for detailed hard to read graphics. Additionally, an application 96 on the smart device 90 as described above could drive to higher product registration, linking more tightly to consumers that want this added benefit.

Figure 5:
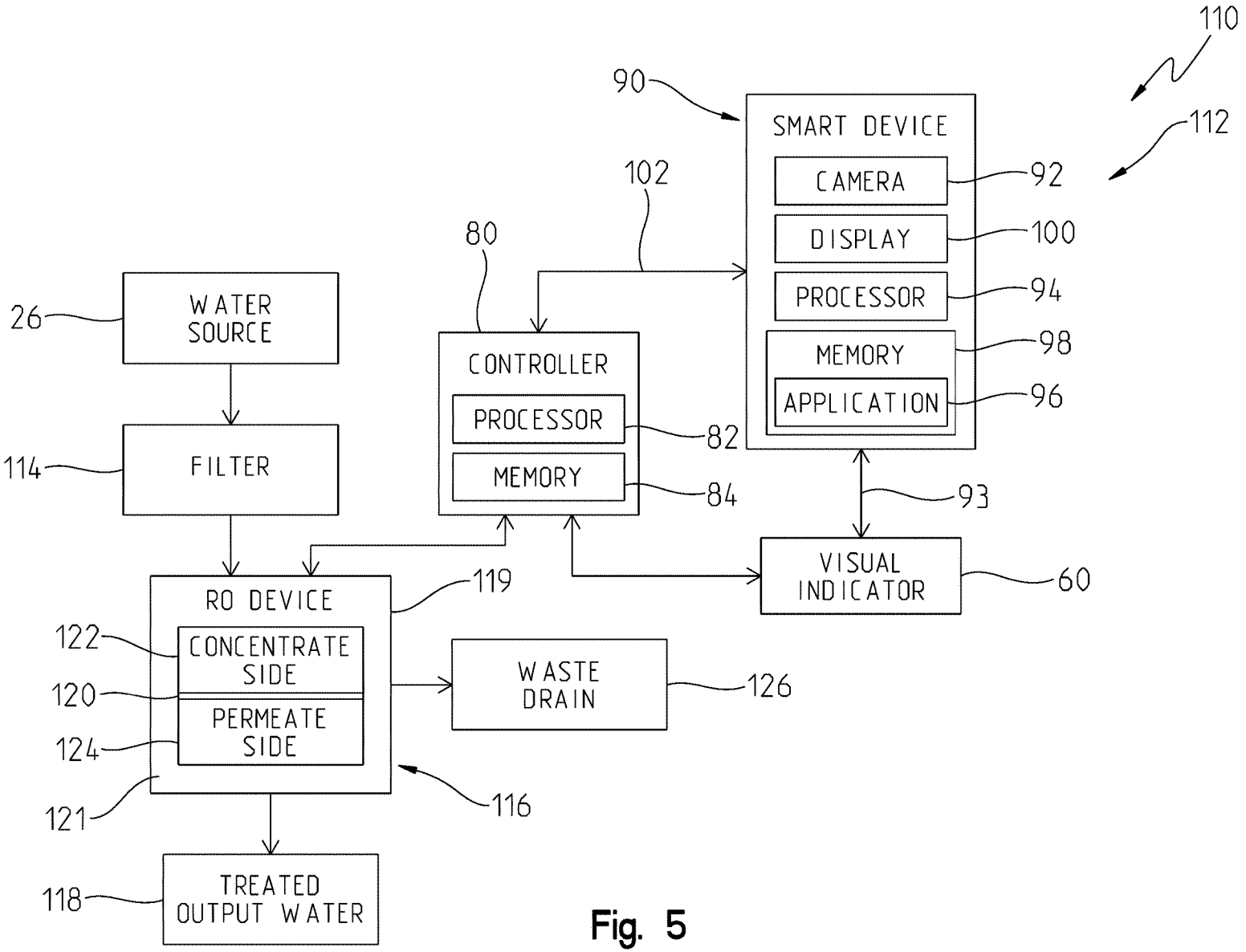
FIG. 5 is a block diagram of a further illustrative fluid delivery device of the present disclosure.

With reference now to FIG. 5, a further illustrative fluid delivery device 110 is shown for use with a diagnostics system 112 of the present disclosure. As further detailed herein, the illustrative fluid delivery device 110 is a water treatment device, such as a water filtration system or a reverse osmosis (RO) system. The fluid delivery device 110 and the diagnostics system 112 illustratively include many similar features as those detailed above in connection with the fluid delivery device 10 and the diagnostics system 12, respectively. As such, in the following description similar features are identified with like reference numbers.

The illustrative reverse osmosis (RO) system 110 includes water source 26 in fluid communication with a filter 114. Filter 114 may be a conventional filter, such as a carbon filter and/or a particulate filter. A reverse osmosis (RO) device 116 is illustratively in fluid communication with the filter 114. The reverse osmosis device 116 may be of conventional design and is configured to provide treated output water 118 to an outlet, such as a valve and/or a faucet.

Illustratively, the reverse osmosis device 116 includes a housing or body 119 defining a fluid passageway 121 receiving a reverse osmosis (RO) filter membrane 120. As is known, the illustrative filter membrane 120 includes a feed or concentrate side 122 (sometimes called a dirty side) and a permeate or purified side 124 (sometimes called a clean side). The concentrate side 122 of the filter membrane 120 is fluidly coupled to a waste drain 126.

Controller 80, including processor 82 and memory 84, illustratively controls operation of the reverse osmosis device 116. The visual indicator 60 is in electrical communication with the controller 80. As further detailed above, the user utilizes the camera 92 on the smart device 90 to read outputs of the visual indicator 60 (e.g., the light indicator 62, the display 64, and/or the fluid pulses 70). The mobile application 96 on the smart device 90 captures the communication and translates it to a message for the user, illustratively on the display screen 100.

As further detailed herein, the indicator 60 could be an audible device (e.g., a speaker) to provide an auditory indication (e.g., a beep, chirp, etc.). In such an illustrative embodiment, the input device 92 could be a microphone to receive input (e.g., a series of beeps or tones) from the audible device 60.

A variety of messages in connection with operation, diagnostics and/or maintenance of the reverse osmosis device 116 may be conveyed to the user via the smart device 90. Such messages may convey, for example, filter life remaining (including detailed information), water usage, system diagnostics (e.g., component failure and/or maintenance required), and/or water quality change (e.g., change in status of baseline water).

Although the invention has been described in detail with reference to certain preferred embodiments, variations and modifications exist within the spirit and scope of the invention as described and defined in the following claims.

The invention claimed is:

1. A fluid delivery device configured to deliver diagnostics read through a smart device, the fluid delivery device comprising:

a faucet body including a spout;

a fluid passageway supported by the spout, the spout having an outlet configured for dispensing fluid;

a faucet visual indicator comprising a light emitting diode supported by the faucet body;

a controller operably coupled to the faucet visual indicator, the controller including a processor in electrical communication with a memory wherein control logic is stored in the memory for execution by the processor, the control logic including a plurality of predefined operating conditions wherein, when one of the plurality of predefined operating conditions is present, the controller controls the faucet visual indicator to display an output corresponding to the one of the plurality of predefined operating conditions and wherein the light emitting diode is configured to change colors or blink to thereby display the output;

a smart device having a camera configured to receive the output from the faucet visual indicator;

wherein the output from the faucet visual indicator is captured by the camera and communicated to the smart device; and wherein the smart device includes a smart device processor configured to translate the output to a message for a user.

2. The fluid delivery device of claim 1, wherein the smart device is wirelessly connected to the controller.

3. The fluid delivery device of claim 1, wherein the smart device further includes a mobile application configured to be executed by the smart device processor.

4. The fluid delivery device of claim 1, wherein the plurality of predefined operating conditions include at least one condition that will generate an output providing diagnostic information wherein the diagnostic information is selected from the group consisting of an error code, a fault code, an indication that a component is malfunctioning, an indication that a component requires service, and an indication that a component requires replacement.

5. The fluid delivery device of claim 4, wherein the plurality of predefined operating conditions include at least one condition that will generate an output providing a status of the fluid delivery device.

6. A fluid delivery device configured to deliver diagnostics read through a smart device, the fluid delivery device comprising:

a fluid passageway;

a visual indicator operably coupled to the fluid passageway, the visual indicator comprising a light emitting diode supported by the fluid delivery device;

a controller operably coupled to the visual indicator, the controller including a processor in electrical communication with a memory wherein control logic is stored in the memory for execution by the processor, the control logic including a plurality of predefined operating conditions wherein, when one of the plurality of predefined operating conditions is present, the controller controls the faucet visual indicator to display an output corresponding to the one of the predefined operating conditions and wherein the light emitting diode is configured to change colors or blink to thereby display the output;

a smart device having a smart device processor and a camera operably coupled to the smart device processor, the camera configured to receive the output from the visual indicator;

wherein the output from the visual indicator is captured by the camera and communicated to the smart device processor; and wherein the smart device processor is configured to translate the output to a message for a user.

7. The fluid delivery device of claim 6, wherein the fluid passageway is defined by a filtration device.

8. The fluid delivery device of claim 6, wherein the plurality of predefined operating conditions include at least one condition that will generate an output providing diagnostic information wherein the diagnostic information is selected from the group consisting of an error code, a fault code, an indication that a component is malfunctioning, an indication that a component requires service, and an indication that a component requires replacement.

9. The fluid delivery device of claim 8, wherein the plurality of predefined operating conditions include at least one condition that will generate an output providing a status of the fluid delivery device.

10. A fluid delivery device configured to deliver diagnostics read through a smart device, the fluid delivery device comprising:

a faucet body including a spout;

a fluid passageway supported by the spout, the spout having an outlet configured for dispensing fluid;

a faucet indicator comprising an audible indicator;

a controller operably coupled to the faucet indicator, the controller including a processor in electrical communication with a memory wherein control logic is stored in the memory for execution by the processor, the control logic including a plurality of predefined operating conditions wherein, when one of the plurality of predefined operating conditions is present, the controller controls the faucet indicator to generate an output corresponding to the one of the plurality of predefined operating conditions; and wherein the output from the faucet indicator is captured by an input device of a smart device having a smart device processor, the output is communicated to the smart device processor and the smart processor is configured to translate the output to a message for a user and wherein the input device is a microphone.

11. The fluid delivery device of claim 10, wherein the plurality of predefined operating conditions include at least one condition that will generate an output providing diagnostic information wherein the diagnostic information is selected from the group consisting of an error code, a fault code, an indication that a component is malfunctioning, an indication that a component requires service, and an indication that a component requires replacement.

12. The fluid delivery device of claim 11, wherein the plurality of predefined operating conditions include at least one condition that will generate an output providing a status of the fluid delivery device.

13. The fluid delivery device of claim 10, wherein the audible indicator generates a beep or a chirp.

14. A fluid delivery device configured to deliver diagnostics read through a smart device, the fluid delivery device comprising:

a fluid passageway;

a visual indicator comprising a light emitting diode operably coupled to the fluid passageway;

a controller operably coupled to the visual indicator, the controller including a processor in electrical communication with a memory wherein control logic is stored in the memory for execution by the processor, the control logic including a plurality of predefined operating conditions wherein, when one of the plurality of predefined operating conditions is present, the controller controls the visual indicator to display an output corresponding to the one of the plurality of predefined operating conditions and wherein the light emitting diode is configured to change colors or blink to thereby display the output;

wherein the output from the visual indicator is configured to be captured by a camera of a smart device; and wherein the smart device is configured to translate the output to a visual message for a user.

15. The fluid delivery device of claim 14, wherein the fluid passageway is defined by a filtration device.

16. The fluid delivery device of claim 15, wherein the filtration device comprises a reverse osmosis device.

17. The fluid delivery device of claim 14, wherein the plurality of predefined operating conditions include at least one condition that will generate an output providing diagnostic information wherein the diagnostic information is selected from the group consisting of an error code, a fault code, an indication that a component is malfunctioning, an indication that a component requires service, and an indication that a component requires replacement.

18. The fluid delivery device of claim 17, wherein the plurality of predefined operating conditions include at least one condition that will generate an output providing a status of the fluid delivery device.

* * * * *